United States Patent [19]

Handley

[11] Patent Number: 4,797,536

[45] Date of Patent: Jan. 10, 1989

[54] TEMPERATURE CONTROL APPARATUS FOR A WATERBED

[75] Inventor: Jerome D. Handley, Palmdale, Calif.

[73] Assignee: Electrofilm, Inc., Valencia, Calif.

[21] Appl. No.: 846,368

[22] Filed: Mar. 31, 1986

[51] Int. Cl.[4] ..... H05B 1/02

[52] U.S. Cl. ..... 219/494; 219/328; 219/217; 219/449; 5/422

[58] Field of Search ..... 219/330, 497, 331, 501, 219/508, 506, 328, 217, 494, 201, 528, 345, 447, 448, 449; 5/422

[56] References Cited

U.S. PATENT DOCUMENTS

| | | | |
|---|---|---|---|
| 2,842,651 | 7/1955 | Neely | 219/19 |
| 3,585,356 | 6/1971 | Hall | 219/217 |
| 3,746,835 | 7/1973 | Yu et al. | 219/217 |
| 3,840,985 | 10/1974 | Miller | 29/611 |
| 3,982,098 | 9/1976 | Trostler | 219/501 |
| 4,156,808 | 5/1979 | Bardeau | 219/449 |
| 4,352,976 | 10/1982 | McMullan | 219/217 |
| 4,405,855 | 9/1983 | Kolle et al. | 219/501 |
| 4,419,721 | 1/1985 | Davis | 219/217 |
| 4,449,035 | 5/1984 | Schwob | 219/449 |
| 4,455,472 | 6/1984 | Moss | 219/217 |
| 4,459,469 | 7/1984 | Ishima | 219/497 |
| 4,591,694 | 5/1986 | Phillips | 219/217 |

*Primary Examiner*—M. H. Paschall

*Attorney, Agent, or Firm*—Lyon & Lyon

[57] ABSTRACT

A system for controlling the temperature of a waterbed and preventing overheating of a waterbed heater. The system places temperature control sensing means and/or replaceable thermal fuse means in thermal contact with a waterbed heater mounted on thermally conducting means, and thus prevents overheating of the waterbed heater and waterbed.

6 Claims, 1 Drawing Sheet

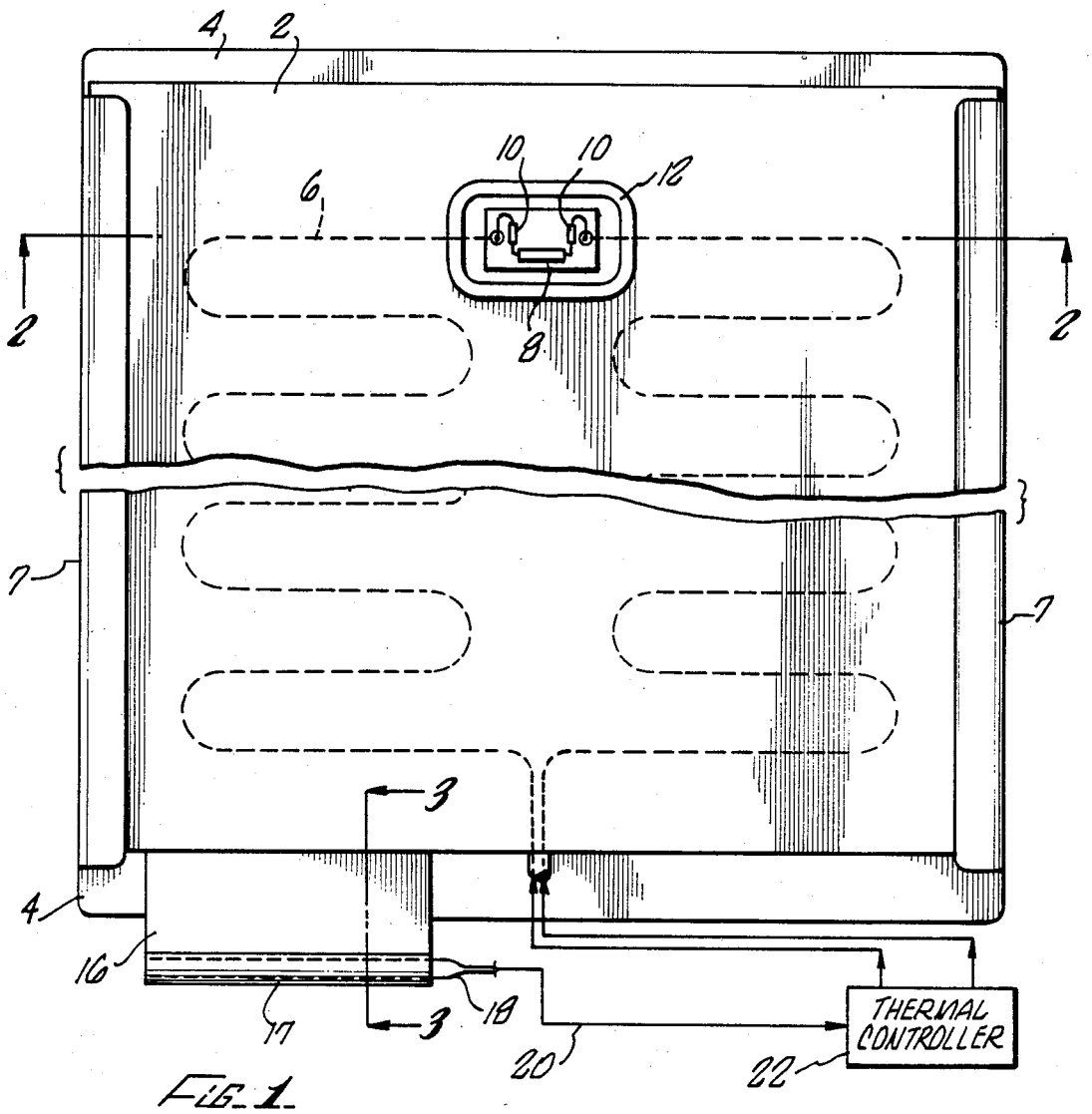
FIG. 1
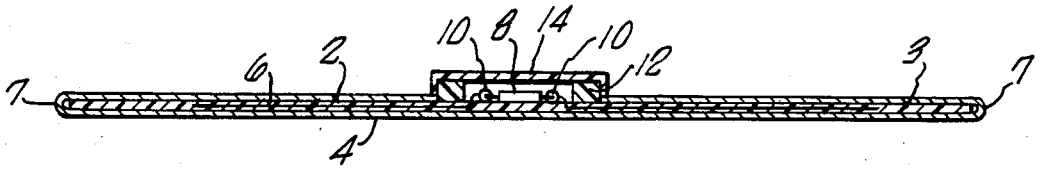
FIG. 2
FIG. 3
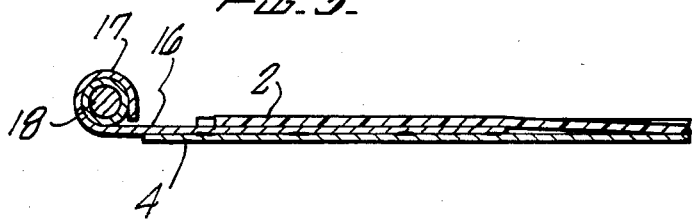

TEMPERATURE CONTROL APPARATUS FOR A WATERBED

FIELD OF THE INVENTION

The present invention relates to waterbed heaters, and is more particularly directed to control systems for waterbed heaters.

BACKGROUND OF THE INVENTION

In the past, waterbed heaters have used various thermal sensing means in order to prevent the overheating of the waterbed heater with its consequent damage to items in contact with the heater, such as a waterbed mattress. Thus, Trostler, U.S. Pat. No. 3,982,098, discloses a temperature-sensitive fuse, item 23 in FIG. 2, encapsulated between two pieces of plastic. Trostler also discloses over-temperature control circuitry utilizing thermistors, T-1 and T-2 in FIG. 6, encapsulated between two pieces of plastic. Miller, U.S. Pat. No. 3,840,985, discloses an overheat thermostat, item 38 in FIG. 5, built into the heater.

While these devices do provide some protection against overheating, the overheating protection devices used in the prior art do not guide against the possibility that a waterbed mattress will be partially drained, leaving a portion of the waterbed heater covered only by the waterbed mattress, liner, bedding and similar materials, and not covered by water. In such a situation, the portion of the waterbed heater that is not covered by water may overheat.

In addition to sensing an overheat condition, prior art waterbed heaters may additionally use a variety of means to sense the temperature of the water in the waterbed. Hall, U.S. Pat. No. 3,585,356, discloses a temperature sending bulb, item 66 in FIG. 8. McMullan, U.S. Pat. No. 4,352,976, discloses a temperature-sensing device, item T in FIG. 9, molded into the heater cord. As used in the prior art, temperature control sensing means differ from overheat sensing means in that overheat sensing means as employed by the prior art react only to an overheat condition, while the temperature control sensing means of the prior art react only to a narrow range of temperatures which does not include the temperatures found during an overheat condition. By the present invention it is desired to build a system in which a temperature control sensing means can be used to detect an overheat condition, yet still respond with adequate sensitivity to the temperature changes found during normal operation of the waterbed heater. Such temperature control sensing means can be used alone, or in conjunction with prior art overheat sensing means.

It is desired to provide a system for detecting and/or preventing the localized overheating of a waterbed heater, as described above. It is further desired to build a heater that will operate for long periods of time under abnormal conditions, such as partial or full drainage of the waterbed, without damage to the waterbed system, which system includes the heater, waterbed mattress, waterbed liner, bedding, and other materials. It is also desired to provide a means by which water temperature may be controlled to within a very small range of temperatures, for exmaple, 1° Fahrenheit, when the waterbed heater is operating under normal conditions, and to continue to control the waterbed heater surface temperature to a safe level when water is partially or wholly removed from the waterbed mattress.

SUMMARY OF THE INVENTION

The present invention is directed to means for preventing the overheating of a waterbed heater. To this end, a waterbed heater may be associated with various heat-distribution means and/or temperature-sensing means.

BRIEF DESCRIPTION OF THE DRAWINGS

FIG. 1 shows a top plan view of the preferred embodiment of the present invention.

FIG. 2 shows a cross-section along line 2—2 in FIG. 1.

FIG. 3 shows a cross-section along line 3—3 in FIG. 1.

DETAILED DESCRIPTION OF THE PREFERRED EMBODIMENT

In FIG. 1, waterbed heater means 2 is mounted to thermally conducting means 4. Thermally conducting means 4 may consist of a metal plate, such as a plate made out of aluminum, or another type of thermally conducting plate. Waterbed heater means 2 may consist of a standard waterbed heater blanket comprising a serpentine resistive conductor 6 embedded in plastic 3 such as Electrofilm's "Aqua Queen TM" waterbed heater Model 600S. Waterbed heater means 2 may be mounted to thermally conducting means 4 by crimping two edges 7 of thermally conducting means 4 around waterbed heater means 2, as shown in FIG. 2. Other mounting methods well known in the art, such as glue, may also be used, as long as thermal contact between thermally conducting means 4 and waterbed heater means 2 is maintained such that the thermal conductivity between thermally conducting means 4 and waterbed heater means 2 is not significantly decreased by separation of the two or by providing an insulating barrier.

Thermal fuse means 8 is mounted in a replaceable fashion in a standard mounting device 10 as is well known in the art. Mounting device 10 may, for example, be AMP Terminal 42923-2, or any equivalent device known to those in the art. Thermal fuse 8 may consist of any of many commercially available fuses, such as Micro Devices' "Micro Temp TM" fuse Model 4178A.

Thermal fuse means 8 and mounting device 10 are mounted within enclosure 12 with removable lid 14, which is shown in FIG. 2. Enclosure 12 may be made of plastic or other suitable material, and may be injection-molded or otherwise suitably fastened onto waterbed heater means 2. Thus, thermal fuse 8 is in indirect thermal contact with the waterbed and waterbed heater means 2 when, as in use, waterbed heater means 2 is placed under a waterbed, since thermal fuse means 8 is then located on top of waterbed heater means 2 and under the waterbed.

Thermally conducting means 4 has temperature sensing means holder 16 attached to it. Temperature sensing means holder 16 may be made from aluminum or any other thermal conductor, and may have a rolled portion 17 for holding temperature sensing means 18. Temperature sensing means holder 16 may be attached to thermal plate 4 by glue, screws, or any other suitable attachment method that will not significantly decrease the thermal conductivity between temperature sensing means holder 16 and thermally conducting means 4. Temperature sensing means holder 16 may also be formed from the same plate as thermally conducting means 4.

Temperature control sensing means 18 are mounted to temperature sensing means holder 16 by a slip-fit or other method well known in the art. Temperature control sensing means 18 may consist of a thermal sensing bulb, such as Eaton Corp.'s Model C-5. Capillary 20 connects temperature control sensing means 18 to thermal controller 22, as is well-known in the art. Capillary 20 may be a copper tube with a very small interior diameter for transporting fluid between temperature control sensing means 18 and thermal controller 22. Capillary 20 and temperature control sensing means 18 may be grounded for added safety of operation. Thermal controller 22 may be any one of a number of standard waterbed thermal controllers, such as Eaton Corp.'s Model C-5.

Equivalent systems of sensing and controlling temperature are also possible, such as a thermostat or thermocouple electrically connected to an electrical thermal controller or any equivalent means known to those in the art.

In the preferred embodiment, thermally conducting means 4 carries heat away from any potential hot spots on waterbed heater means 2, thus assuring that waterbed heater means 2, thermally conducting means 4, and the waterbed are all at approximately the same temperature when a waterbed is placed above waterbed heater means 2 in normal use. Temperature control sensing means 18 is placed in thermal contact with thermally conducting means 4 by means of the thermally conductive holder 16 extending therebetween. Thus the temperature control sensing means 18 continually senses the temperature of the holder 16. Capillary 20 carries fluid from and to temperature control sensing means 18 when changing temperatures of thermally conducting means 4 are transmitted to the holder 16 which causes fluid located in temperature control sensing means 18 to expand and contract. Capillary 20 is connected to thermal controller 22 and transmits fluid to and from thermal controller 22 in response to changing temperatures of the holder 16, as discussed above. Thermal controller 22 senses changing fluid pressure resulting from fluid flowing into and out of it because of changing temperatures, and determines whether a temperature selected by the waterbed user and entered into the controls of thermal controller 22 has been reached. As indicated above, during normal usage, that the temperature of the heater means 2, conducting means 4, the water in the waterbed and the holder 16 would be the same. If the selected temperature has not been reached, thermal controller 22 allows current to flow through resistive conductor 6, thus causing waterbed heater means 2 to heat the waterbed. During such time, the heater, of course, will be at a slightly higher temperature than the conducting means 4, which in turn will be at a slightly higher temperature than the holder 16 due to the temperature losses or gradient across the respective element. The temperature actually sensed by sensing means 18 would then simply be the temperature of the conducting means 4 less the temperature loss across the holder 16. If the selected temperature has been reached, thermal controller 22 shuts off the current to resistive conductor 6 and thereby prevents further heating of the waterbed by waterbed heater means 2. When the waterbed has lost enough heat through conduction and other sources such that the loss of heat causes the holder 16 to drop below a threshold temperature which is associated with the selected waterbed temperature, thermal controller 22 again allows current to flow through resistive conductor 6 causing waterbed heater means 2 to again heat the waterbed.

When the waterbed is partially or fully drained, heat is again conducted away from potential hot spots on waterbed heater means 2 through thermally conducting means 4. As the water is removed from the system and can no longer function as a heat sump for the thermally conducting means 4, the temperature of the heater means 2 and the thermally conductive means 4 will continue to rise. The rise of temperature of the thermally conducting means 4 will raise the temperature of the holder 16. When the temperature of the holder 16 reaches a predetermined level corresponding to an unsafe temperature level in the waterbed heater means 2, the temperature sensing means 18 detects the relatively high temperature and the thermal controller 22 shuts off the current to the resistive conductor 6. Because the holder 16 spaces the temperature sensing means 18 from the thermally conducting means 4, when the heating means 2 is on, the temperature of the holder 16 will necessarily be less than the temperature of the thermally conducting means 4. Accordingly, the temperature sensing means 18 will encounter and have to react to a smaller temperature fluctuation than if the temperature sensing means 18 were thermally coupled directly to the thermally conducting means 4, thereby improving the sensitivity and operation of the protective system. As a backup to the above described system, if a high temperature that approaches an unsafe temperature is reached, thermal fuse 8 will open, thus opening the circuit of resistive conductor 6 and thereby causing waterbed heater means 2 to stop heating the waterbed.

Thus, a system for controlling the temperature of a waterbed and a waterbed heater is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An apparatus for controlling the temperature of the water in a waterbed in preventing localized overheating during use, said apparatus comprising: a substantially flat heater means for heating the water in the waterbed; a substantially flat thermally conductive plate adjacent to and in thermal contact with said heater means; a thermally conductive member disposed in thermal contact with said plate and defining holding means outwardly spaced from said plate, temperature sensing means carried by said holding means in thermal contact with said thermally conductive member for sensing the temperature of said member; and temperature control means in operative communication with said temperature sensing means and said heater means for activating and deactivating said heater means in response to variations in the temperature of said thermally conductive member.

2. The apparatus combination of claim 1 wherein said plate and said heater means define adjacent end portions and including means for securing said end portions together such that said heater means is secured to said plate about the perimeter thereof and in thermal contact therewith.

3. The apparatus combination of claim 1 or 2 including replaceable thermal fuse means for sensing an overheating condition in said heating means and deactivating said heating means in response to said over-heating condition.

4. An apparatus for controlling the temperature of the water in a waterbed and preventing both localized overheating during use and overheating upon the removal of all or a substantial portion of the water from the waterbed, said apparatus comprising: a substantially flat heater means for heating the water in the waterbed; a substantially flat thermally conductive plate, said plate being disposed adjacent said heater means and defining edge portions, said edge portions extending about portions of said heater means and securing said heater means to said plate in thermal contact therewith such that heat generated by said heater means is evenly distributed by said plate; a thermally conductive member in thermal contact with said plate and defining holding means outwardly spaced from said plate, temperature sensing means carried by said holding means in thermal contact with said thermally conductive member for sensing the temperature of said member; and temperature control means in operative communication with said temperature sensing means and said heating means for activating said heating means in response to variations of the temperature of said thermally conductive member.

5. The apparatus combination of claim 1 or 2 including replaceable thermal fuse means carried by said heating means for sensing an over-heating condition of said heating means and deactivating said heating means in response to said over-heating condition.

6. The apparatus of claim 1 or 4 wherein said member is of integral construction and defines inner and outer end portions, one of said end portions being in thermal contact with said plate and the other of said end portions being outwardly disposed from said plate and terminating in said holding means, said holding means extending about at least a portion of said temperature sensing means for securing said temperature means to said member.

* * * * *